United States Patent [19]

Murata et al.

[11] 4,071,721

[45] Jan. 31, 1978

[54] SEQUENTIAL CONTROLLER

[75] Inventors: Tomoji Murata; Yoshihiro Nakamura, both of Toyokawa; Kenji Shibazaki, Aichi; Matsuo Kuse, Toyokawa, all of Japan

[73] Assignee: Minolta Camera Kabushiki Kaisha, Osaka, Japan

[21] Appl. No.: 660,405

[22] Filed: Feb. 23, 1976

[30] Foreign Application Priority Data

Mar. 8, 1975 Japan ..... 50-28413

[51] Int. Cl.[2] ..... H01H 43/10

[52] U.S. Cl. ..... 200/38 B; 200/38 R; 307/141

[58] Field of Search ..... 307/141; 200/38 R, 38 B, 200/38 BA, 38 C, 153 LB

[56] References Cited

U.S. PATENT DOCUMENTS

| | | | |
|---|---|---|---|
| 2,670,039 | 2/1954 | Burkholder | 200/38 B |
| 2,858,387 | 10/1958 | Crimmins | 200/153 LB |
| 2,941,666 | 6/1960 | Sims, Jr. | 307/141 |
| 3,200,209 | 8/1965 | Fitzgerald | 200/38 BA |
| 3,380,365 | 4/1968 | Umahashi | 200/38 B |
| 3,823,329 | 7/1974 | Crook et al. | 307/141 |
| 3,937,910 | 2/1976 | Fukami | 200/38 R |

*Primary Examiner*—Robert K. Schaefer
*Assistant Examiner*—Eugene S. Indyk
*Attorney, Agent, or Firm*—Wenderoth, Lind & Ponack

[57] ABSTRACT

In operating an apparatus provided with a plurality of various component devices incorporated therein, it is necessary to provide some type of sequential controller when the plurality of the devices are required to be operated sequentially for predetermined periods, independently of each other. The improved type of sequential controller of the present disclosure has a plurality of cam plates each of which is provided with switch units for controlling the operating periods of the various component devices, and which are rotated by a driving means, a lock claw for engaging with the cam plates and a controller for controlling the movement of the lock claw, so that the predetermined rotation of the cam plates controls the operating periods of the various devices.

13 Claims, 17 Drawing Figures

IA
IB
IC
10 58 59 60 55 56 57
57 58
55 56 58
57

IA
IB
IC
10 59 ←V' 60
58
56 58
57

IA
IB
IC
59 ←V'
59 ←V'
57 58 59 ←V'

IA
IB
IC
59 ←V' 60 55 56
59 ←V'
58 59 ←V'

IA
IB
IC
56 57 58 ←V'
60 55 56 ←V'
58
10

IA
IB
IC
10 57 58
55 56
58 59 60

SEQUENTIAL CONTROLLER

The present invention relates to a sequential controller, and more particularly, to an improvement in a sequential controller for use, for example, in a copying apparatus for controlling timing of operations of various devices incorporated in the copying apparatus, so as to effect copying operations in a predetermined sequence.

Generally, sequential controllers are widely employed in apparatuses having various component devices therein for actuating such component devices individually in predetermined sequence. One type of such apparatus, for example, a copying apparatus includes various component devices such as a corona charger for uniformly charging a photoconductive surface of a photoreceptor, an exposure device for illuminating an original to be copied and for transmitting a pattern thereof onto the photoreceptor, and a developing device for developing an electrostatic latent image of a transferred pattern of the original on a copy material into a visible image, which component devices are not operated simultaneously, but operated individually in a predetermined order by a plurality of switch means coupled with the sequential controller.

In the known sequential controller of the above described type, it has been a common practice to use a plurality of cams which cams are operated in manners different from each other, in rotating speeds or in the combination of rotating and non-rotating periods thereof.

There have conventionally been proposed various methods for controlling the rotation of the cams in such sequential controllers, which methods can be broadly divided into three different types as described hereinbelow.

A first method utilizing a plurality of motors with their shafts being fixedly connected to corresponding cams, while rotation of each motor is controlled by a suitable control means coupled with the motor, thus providing individual rotation to each of the cams.

A second method wherein clutch means is provided on each of the cam shafts between the cams, or between each of the motors and the cams with suitable clutch shifting means to engage and disengage the clutches, so that each of the cams can be driven independently.

A third method wherein rotating discs or the like frictionally engaged with each of the cams are employed, which cam is normally rotated together with the disc, but can be locked by suitable claw means engageable with a suitable notch formed on a periphery of the cam, thus movement of each of the claw means is individually regulated by suitable control means to cause the cams to rotate individually.

However, the above described methods have such disadvantages that the numerous parts required in the sequential controller for controlling the rotation of each cam result in a complicated mechanism and also call for precise adjustments in positioning each of the cams and/or claw means.

Therefore, the primary object of the present invention is to provide an improved type of sequential controller having a simple construction.

Another object of the present invention is to provide a sequential controller for use, for example, in a copying apparatus which can control the operating periods for various component devices of the copying apparatus.

According to the sequential controller of the present invention described with reference to a copying apparatus, a plurality of cams for controlling the switch units are mounted on the driving shaft, which cams are normally simultaneously rotated with the driving shaft, while the lock claw for restricting the rotation of the cams against the frictional force acting between the driving shaft and the cams, is pivotally disposed adjacent to the cams for engagement with or disengagement from the cams upon receipt of signals produced from the electrical circuit means coupled with the sequential controller.

These and other objects and features of the present invention will become apparent from the following description taken in conjunction with preferred embodiments thereof with reference to the accompanying drawings, in which.

Figure 6:
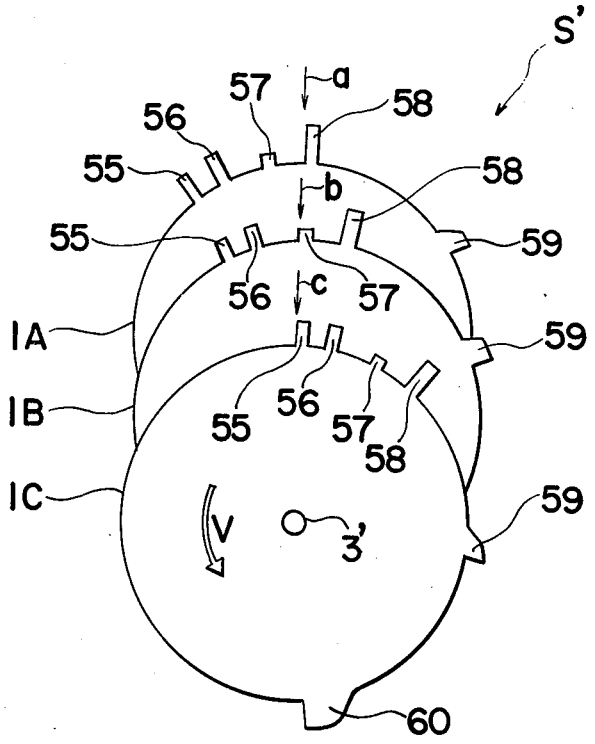
FIG. 6 is a front view of three cam plates in another embodiment of the invention, showing an arrangement thereof at a starting position.
Figure 10:
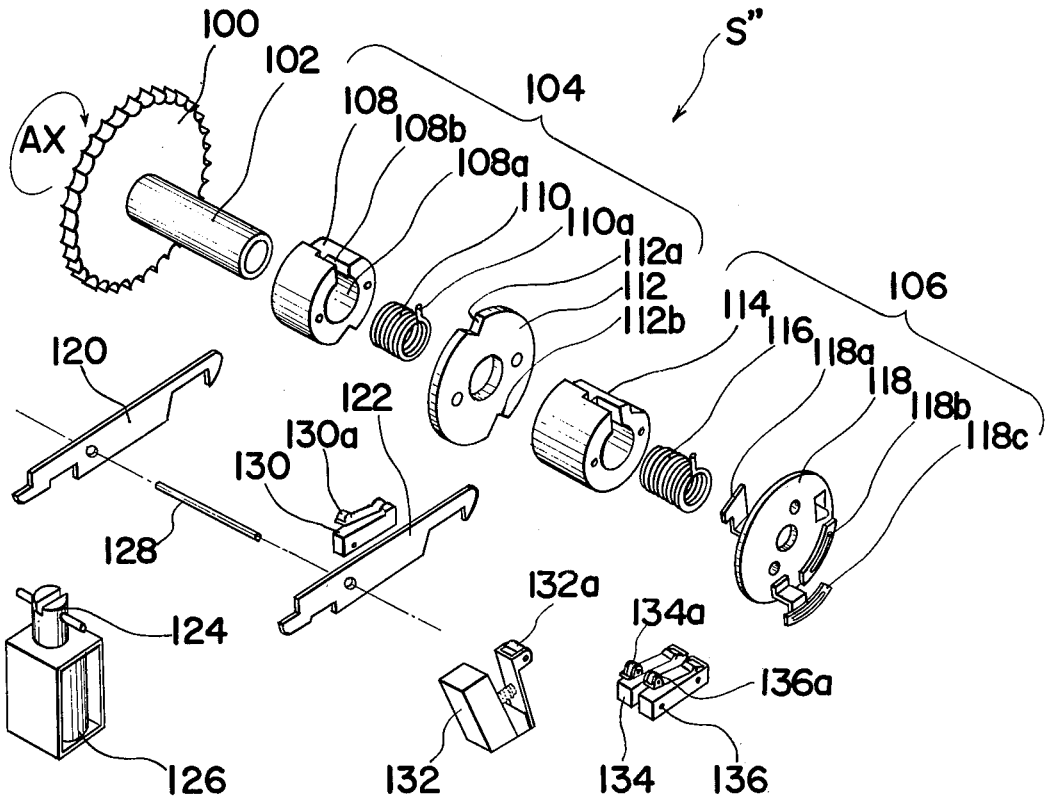
Figure 11:
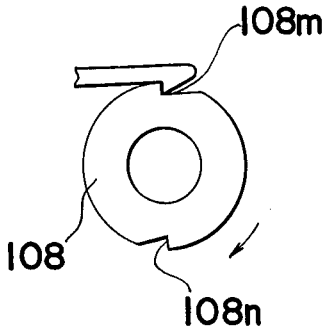
Figure 11:
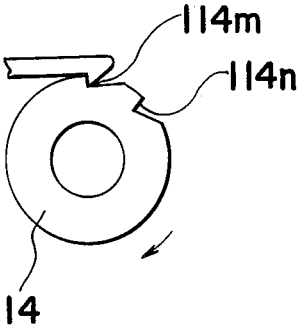

FIGS. 9(A) through 9(F) are schematic diagrams showing movements of the cam plates shown in FIG. 6;

FIG. 10 is an exploded perspective view of cam units in a further embodiment of the invention, with mechanisms associated therewith; and FIGS. 11(A) and 11(B) are schematic diagrams showing side views of the clutch cams shown in FIG. 10.

Before the description of the present invention proceeds, it is to be noted that like elements are designated by like reference numerals throughout the attached drawings.

Figure 1:
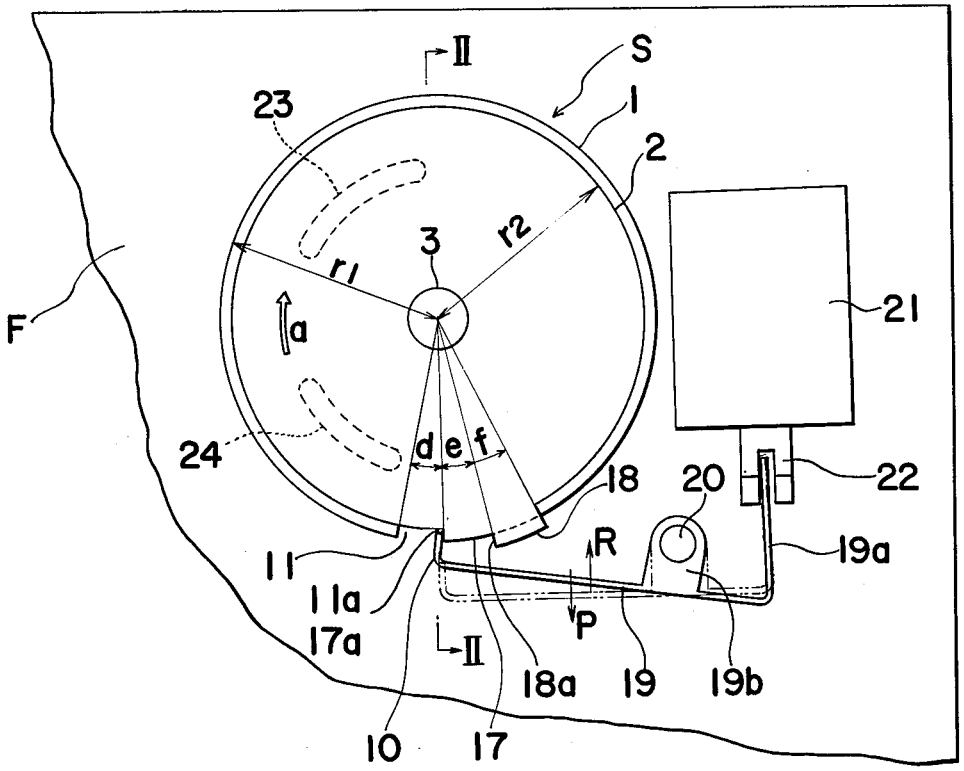
FIG. 1 is a schematic diagram of a sequential controller of the present invention, at a starting position.
Figure 2:
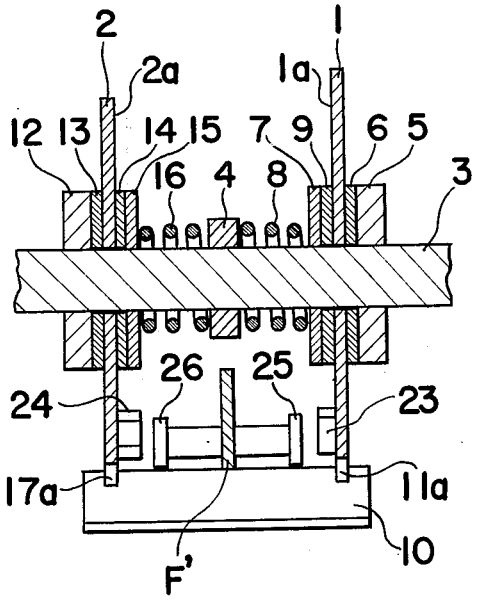
FIG. 2 is a cross sectional view taken along the line II—II of FIG. 1.

Referring to FIGS. 1 and 2, mounted on a frame F for an apparatus, such as electrophotographic copying apparatus (not shown) is a sequential controller S which comprises cam plates 1 and 2 rotatably mounted on a driving shaft 3 coupled with a suitable driving means (not shown), in spaced relation to each other. In the central position of the space between these cam plates 1 and 2, a ring 4 is fixedly mounted on the driving shaft 3. On the right side of the cam plate 1, as most clearly seen in FIG. 2, a ring 5 is fixedly mounted on the driving shaft 3, whereas on the left side of the cam plate 1, a ring 7 is movably mounted on the driving shaft 3 so as to be able to shift its position along the driving shaft 3, so as to hold the cam plate 1 between the rings 5 amd 7. In a space between the cam plate 1 and the ring 5, and also in a space between the cam plate 1 and the ring 7, friction members 6 and 9 are disposed, respectively, while a spring 8 is mounted on the shaft 3 between the rings 4 and 7 for urging the ring 7 rightwardly in FIG. 2 to transmit the rotating force of the driving shaft 3 to the cam 1 through the friction members 6 and 9, thus normally causing the cam plate 1 to rotate simultaneously with the rotation of the driving shaft 3.

As in a manner similar to that described with respect to the cam plate 1, the cam plate 2 is also sandwiched between a ring 12 fixedly mounted on the driving shaft 3 and a ring 15 displacably mounted on the same shaft 3, while friction materials 13 and 14 are disposed on the shaft 3 in spaces between the cam plate 2 and the ring 12 and between the cam plate 2 and the ring 15, respectively, and a spring 16 is mounted on the shaft 3 between the rings 4 and 15 for urging the ring 15 leftwardly in FIG. 2 to transmit the rotating force of the driving shaft 3 to the cam plate 2 through the friction materials 13 and 14, thus normally causing the cam plate 2 to rotate in the direction *a* simultaneously with the rotation of the driving shaft 3.

Positioned below and adjacent to the cam plates 1 and 2, a lock lever 19 extends in a direction parallel to a line tangent to the cam plates 1 and 2, the left end of which lock lever 19 is integrally formed into or fixedly provided with a lock claw 10 having a width larger than the distance between the cam plates 1 and 2, and extending upwardly at right angles from the lock lever 19, while the right end of the lock lever 19 is also integrally formed into or fixedly provided with connecting plate 19*a* extending upwardly at approximately right angles from the lock lever 19 for being connected with a plunger 22 of a solenoid 21 described more in detail later. At an intermediate portion of the lock lever 19, a plate 19*b* integrally formed with or fixedly mounted on the lever 19 extends upwardly from the lock lever 19, with an opening (not shown) formed in approximately the center portion of the plate 19*a* for pivotally supporting the lock lever 19 together with lock claw 10 and connecting rod 19*a* by a pin 20 secured on the frame F, so that when the plunger 22 extends outwardly from the solenoid 21, which is a normal condition of the plunger 22 in solenoid 21, the lock lever 19 is pivoted in a direction R about the pin 20 for engaging the upper edge of the lock claw 10 with a peripheral surface of at least one of the cam plates 1 and 2. On the other hand, when the solenoid 21 is excited and the plunger 22 is retracted into the solenoid 21, the lock lever 19 is now pivoted in the direction P about the pin 20 to disengage the lock claw 10 from the peripheral surface of the cam plates.

As shown in FIG. 1, the radius r1 of the cam plate 1 is greater than the radius r2 of the cam plate 2. The cam plate 1 has formed in its peripheral edge a detented recess 11 subtending an angle of *d* on the circumference of the plate 1, while the cam plate 2 has formed on its peripheral edge two detent projections 17 and 18 which are adjacent each other side by side without any interval therebetween. The first detent projection 17 subtends an angle *e* on the circumference of the cam plate 2 and has its peripheral edge approximately coinciding with the peripheral edge of the larger cam plate 1, while the second detent projection 18 subtends an angle *f* on the circumference of plate 2 and is located immediately next to the projection 17 at the side thereof opposite to the cam rotating direction *a* and has its peripheral edge further extending radially outwardly from the peripheral edge of the larger cam plate 1.

On an inner surface 1*a* of the cam plate 1, i.e., the surface thereof opposed to the inner surface 2*a* of the cam plate 2, an arcuate magnet element 23 is fixedly disposed in a position spaced from and parallel to the peripheral edge of the cam plate 1, one end of which element 23 is separated by a predetermined angle from the detent recess 11, while a lead switch 25 is rigidly secured to a plate F′ extending from the frame F in such a manner that the magnet element 23 will pass closely adjacent to the lead switch 25 during the rotation of the cam plate 1, thereby actuating the lead switch 25 by the magnetic force of the magnet element 23. Similarly, the inner surface 2*a* of the cam plate 2 is also provided with an arcuate magnet element 25 in a position spaced from and parallel to the peripheral edge of the cam plate 2, one end of which element 24 is separated by a predetermined angle from the detent projection 17 and 18, as shown in FIG. 1, while the lead switch 26 is rigidly secured to the plate F′ in such a manner that the magnet element 24 will pass closely adjacent to the lead switch 26 during the rotation of the cam plate 2, thereby actuating the lead switch 26 by the magnetic force of the magnet element 24.

For a better understanding of the operations of the sequential controller of the invention, several conditions of the cam plates 1 and 2 will be functionally described hereinbelow in connection with the engagement thereof with the lock claw 10.

The first condition is that in which the cam plate 1 is restricted from rotating with the driving shaft 3 due to the rotating force transmitted through the friction members 6 and 9, by the engagement of the lock claw 10 with the side edge 11*a* of the detent recess 11, while the cam plate 2 is also restricted from rotating in a similar manner as described above, by the engagement of the lock claw 10 with the side edge 17*a L of dentent projection 17, as shown in FIG. 1.*

Figure 4:
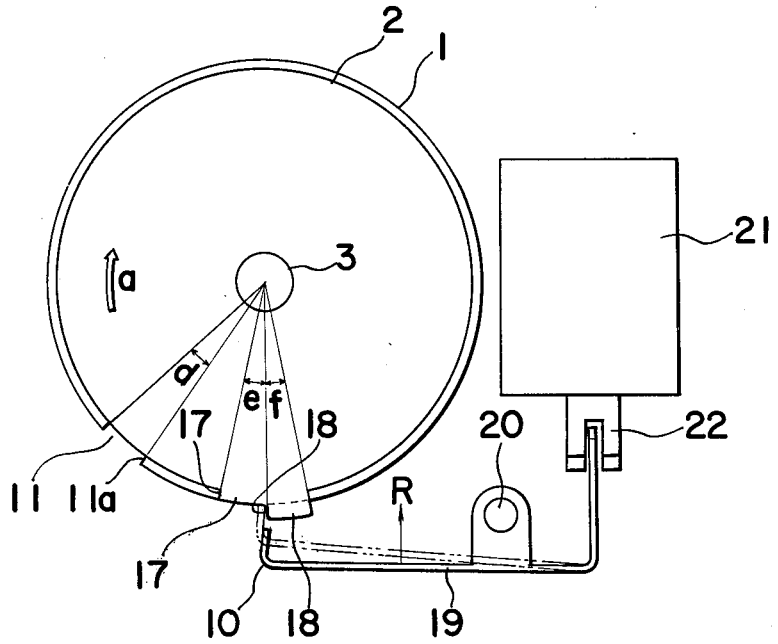
FIG. 4 is a similar view to FIG. 1, but particularly shows the cam plates in a rotating position.

The second condition is that in which the cam plate 1 is rotated with its peripheral edge sliding over the corresponding edge of the lock claw 10, while the cam plate 2 is restricted from rotating by the engagement of the lock claw 10, with the side edge 18*a* of the detent projection 18, as shown in FIG. 4, with the lock claw 10 being in the position shown in chain lines.

The third condition is that in which the cam plate 1 is rotated with its peripheral edge sliding over the corresponding edge of the lock claw 10, while the cam plate 2 is also rotated, without its peripheral edge sliding over the corresponding edge of the lock claw 10 because the peripheral edge of the cam plate 2 is beyond the reach of the corresponding edge of the lock claw 10.

The above described conditions are sequentially brought about, one after one, by the control circuit C, described hereinbelow.

Figure 3:
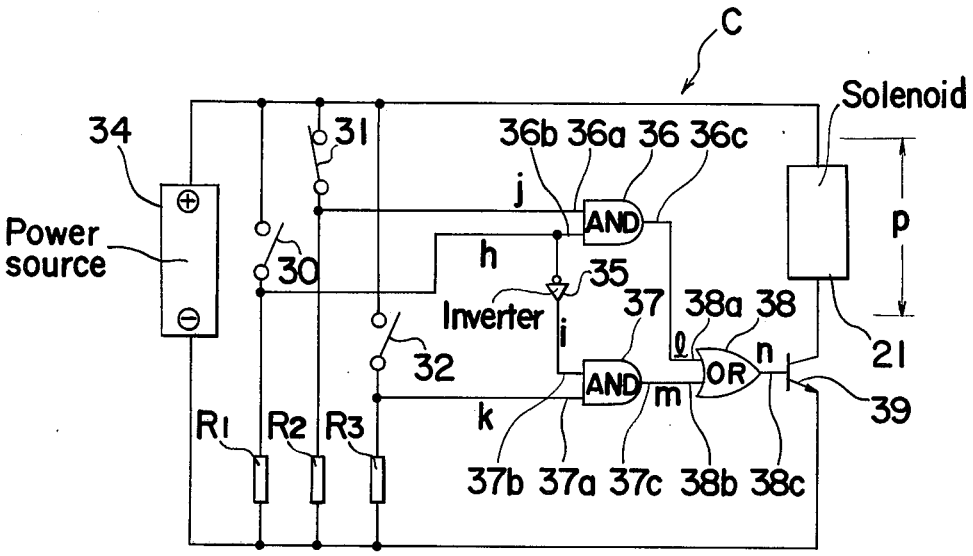
FIG. 3 is an electrical circuit diagram for controlling shifting of a lock claw incorporated in the sequential controller of FIG. 1.

Referring now to FIG. 3, the control circuit C comprises a power source 34 and a solenoid 21 connected in series to the power source 34 through a switching transistor 39. A switch 30 connected in parallel to the power source 34 through a resistor R1, coincides with a switch unit (not shown) incorporated, for example, in an electrophotographic copying apparatus (not shown) for detecting a period when a sheet of copy paper is transported through the electrophotographic copying apparatus, thereby turning on the switch 30 in said period. A switch is connected in parallel to the power source 34 through a resistor R2, and said switch 31 is actuated in accordance with the predetermined position of the cam plate 1 in mutual relation to the lock claw 10. More specifically, the switch 31 is turned on when the cam plate 1 is brought to such a position that the lock claw 10 engages with the detent recess 11 in the cam plate 1, and the switch 31 is turned off after the moment when the recess 11 of the cam plate 1 is disengaged from the lock claw 10, but before the cam 2 has rotated through the angle *e* in the forward direction *a*, which angle is equal to the angle of the detent projection 17. A switch 32 is also connected in parallel to the power source 34 through a resistor R3, and said switch 32 is actuated in accordance with the position of the cam plate 2 in mutual relation to the lock claw 10. More specifically, the switch 32 is turned on when the cam plate 2 is brought to such a position that the detent projection 17 thereof faces the edge of the lock claw 10, and is turned off immediately after the lock claw 10 engages with the detent projection 18.

It should be noted that the switches 31 and 32 may be a pair of lead switches and magnet elements, as the switches 24 and 25, or any other type of known switch units such as photoconductive elements associated with a light source, so long as the switch unit can detect the position of the cam plate.

Still referring to FIG. 3, one input terminal 36*a* of the two input terminals of an AND gate 36 is connected to one terminal of the switch 31, and the other input terminal 36*b* of the AND gate 36 is connected to one terminal of the switch 30, while the output terminal 36*c* of the AND gate 36 is connected to one input terminal 38*a* of the two input terminals of an OR gate 38. In a similar manner, one input terminal 37*a* of the two input terminals of an AND gate 37 is connected to one terminal of the switch 32, and the other input terminal 37*b* of the AND gate 37 is connected to the input terminal 36*b* of the AND gate 36 through an inverter 35 which changes a low level signal to a high level signal or vice versa, while the output terminal 37*c* of the AND gate 37 is connected to the other input terminal 38*b* of the two input terminals of the OR gate 38. The output terminal 38*c* of the OR gate 38 is connected to the base of the switching transistor 39 for controlling the conductive and non-conductive conditions thereof.

In the above described controlling circuit C, various types of voltage signals can be obtained from the output and input terminals of the AND gates 36 and 37, and OR gate 38, which voltage signals can be utilized for controlling the various devices, such as a corona charger, exposure device and developing device, etc., incorporated in the electrophotographic copying apparatus.

For the sake of the present disclosure, the voltage signals at various terminals are designated by reference characters *h* through *n* as listed hereinbelow.

*h:* terminal 36*b*
*i:* terminal 37*b*
*j:* terminal 36*a*
*k:* terminal 37*a*
*l:* terminal 38*a*
*m:* terminal 38*b*
*n:* terminal 38*c*

Figure 5:
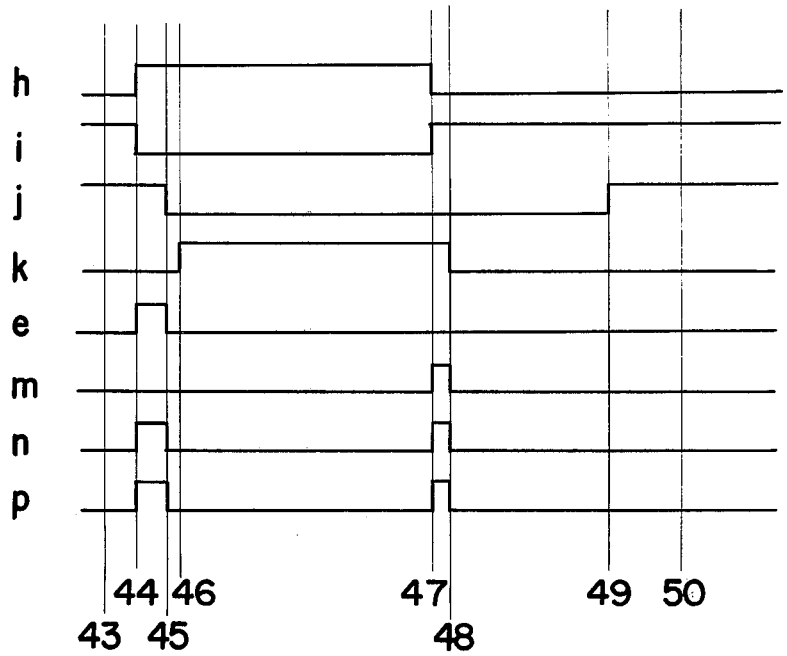
FIG. 5 is a graph showing wave forms of signals produced at various points in the electrical circuit of FIG. 3.

The above described sequential controller S together with the controller circuit C operates in the manner as described hereinbelow in connection with FIG. 5, showing various states of the signals *h* through *n*.

Assuming that the cam plates 1 and 2 are in such positions that the lock claw 10 is engaged with the detent recess 11 of the cam plate 1 and also with the detent projection 17 of the cam plate 2, which state is equal to the first condition described earlier, and also assuming that the copy paper is not yet fed into the electrophotographic copying apparatus, the switches 30, 31 and 32 are in the state of "off", "on" and "off", respectively, whereby causing the signal *j* to be a high level voltage signal (the term high level voltage signal is simply referred to as "high", hereinafter) and the signals *h* and *k* to be zero or low level voltage signal (the term zero or low level voltage signal is simply referred to as "low", hereinafter). Therefore, the signals produced from both AND gates 36 and 37 are "low", thus causing the signal n produced from the OR gate 38 to be low, which will not cause the switching transistor 39 to conduct, and the solenoid 21 remains unexcited, thus keeping the lock claw 10 in the first condition. While the switches 30, 31 and 32 are in the above mentioned states, the signals obtained from the above mentioned various terminals are in the state 43 as shown in FIG. 5.

Upon feeding of the copy paper into the electrophotographic copying apparatus, the switch 30 is turned on, to change the signal *h* from "low" to "high", while the other switches 31 and 32 remain in "on" and "off" state, respectively, thus producing "high" from the AND gate 36 and from the OR gate 38, thereby causing the switching transistor 39, to conduct and exciting the solenoid 21 to retract the plunger 22, and causing the lock claw 10 to disengage from the detent recess 11 and the detent projection 17, and the cam plates 1 and 2 to rotate in the forward direction *a*. During the above mentioned period, the signals *h* through *n* are in the state 44 as shown in FIG. 5.

Before the cam plates 1 and 2 rotate the predetermined angle *e*, the switch 31 is turned to the "off" state, changing the signal *j* from "high" to "low", while the rest of the switches 30 and 32 remain in the "on" and "off" states, respectively, thereby causing signals *h*, *i* and *k* to become "high", "low" and "low", respectively. These signals *h* through *k* cause the AND gates 36 and 37 to produce "low" signals, whereby the OR gate 38 produces a "low" signal which is the signal *n*. This "low" in the signal *n* turns the switching transistor 39 to the non-conductive state for de-energizing the solenoid 21. Accordingly, the extension of the plunger 22 causes the lock claw 10 to contact the peripheral edges of the cam plates 1 and 2. In the mean time, the cam plates 1 and 2 are rotated in the direction of *a*, but not more than the predetermined angle *e*, so that the lock claw 10 will engage with the detent projection 18. During the above described period, the signals *h* through *n* are in the state 45 as shown in FIG. 5.

Upon engagement of the lock claw 10 with the detent projection 18, the switch 32 is turned to the "on" state, while the other switches 30 and 31 are maintained in the "on" and "off" states, respectively, and thus the signals *h*, *i*, *j* and *k* are in the "high", "low", "low", and "high" states, respectively. Therefore, the "low" signal produced from the AND gates 36 and 37 causes the OR gate 38 to produce a "low", signal thereby still maintaining the switching transistor 39 in the non-conductive state, with the lock claw 10 being engaged with the detent projection 18. During this period, the signals *h* through *n* are in the state 46, as shown in FIG. 5.

The above described condition in the sequential controller S is maintained until the moment when said fed copy paper turns the switch 30 to the "off" state at the predetermined position in the copying apparatus, while the rest of the switches 31 and 32 remain in the "off" and "on" states, causing the signals *h* through *k* to be in the states of "low", "high", "low" and "high", respectively, and thus the AND gates 36 and 37 produce "low" and "high" signals, respectively, and the OR gate 38 produces a "high" signal for causing the switching transistor 39 to conduct and exciting the solenoid 21 to disengage the lock claw 10 from the detent projection 18. Therefore, both of the cam plates 1 and 2 are rotated in the direction *a*. During this period, the signals *h* through *n* are in the state 47, as shown in FIG. 5.

After the moment when the detent projection 18 passes the lock claw 10, the switch 32 is turned to the "off" state, while the rest of the switches 30 and 31 remain in the "off" state. Therefore, the signals *h*, *j* and *k* are "low", and the signal *i* is in the "high", thereby causing the OR gate 38 to produce a "low" signal and the switching transistor to become non-conductive, and accordingly the lock claw 10 contacts the cam plates 1 and 2, as described in the third condition above. During said condition, the signals *h* through *n* are in the state 48 as shown in FIG. 5.

The cam plate 1 continually rotates with its peripheral edge sliding over the corresponding edge of the lock claw 10, until the lock claw 10 engages with the detent recess 11 in the cam plate 1, whereas the cam plate 2 continually rotates until the lock claw 10 engages with the detent projection 17 in the cam plate 2, and thus the cam plates 1 and 2 are brought into the starting condition, which is the same as the above described first condition. In this final condition, or the starting condition, the signals *h* through *n* are in the state 49 as shown in FIG. 5.

The next successive sheet of copy paper can be processed in the same manner as described above. But for more rapid operation of the copying apparatus, it is possible to feed the next successive sheet of copy paper before finishing the above mentioned procedure, in which case the next successive sheet of copy paper can be fed into the copying apparatus after any moment when the detent recess 11 of the cam plate 1 engages with the lock claw 10, that is, after the state 49, such as in the state 50 in FIG. 5.

As described above, the cam plate 1 starts to rotate by the first disengagement of the lock claw 10, thereby producing various signals *h* through *n*, and the cam plate 2 starts to rotate by the second disengagement of the lock claw 10, producing other types of signals. Therefore, it is possible to control the actuating period of the various devices such as corona charger, exposure device and developing device by utilizing any of the signals *h* through *n* in desirable periods, which can further be adjusted to a more precise degree, by changing the position of the magnet elements 23 and 24, each provided on the inner surfaces 1*a* and 2*a* of the cam plates 1 and 2, respectively. Since the sequential controller S of the present embodiment is regulated in accordance with the sheet of copy paper fed into the copying apparatus, the exposure period and the developing period can be controlled to suitable periods of time with respect to the changes in the length of the sheet of copy paper, whereby the copy obtained from the copying apparatus will have good contrast and also the expense of operating the copying apparatus can be reduced.

Figure 8:
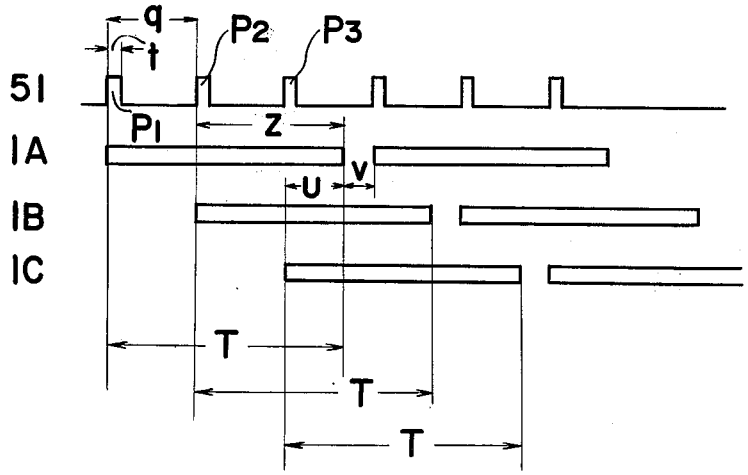
FIG. 8 is a time chart, showing operating periods of the cam plates shown in FIG. 6.

Referring now to FIGS. 6 to 9, there is shown another preferred embodiment of the sequential controller S', which comprises cam plates 1A, 1B and 1C having similar configurations to each other, as most clearly seen in FIG. 6, and a pulse producing circuit (not shown) for producing a pulse after each period of *q*, with a pulse width of *t* as shown in wave form 51 in FIG. 8, for shifting the lock claw 10 to the disengaged condition after each period of *q*.

Figure 7:
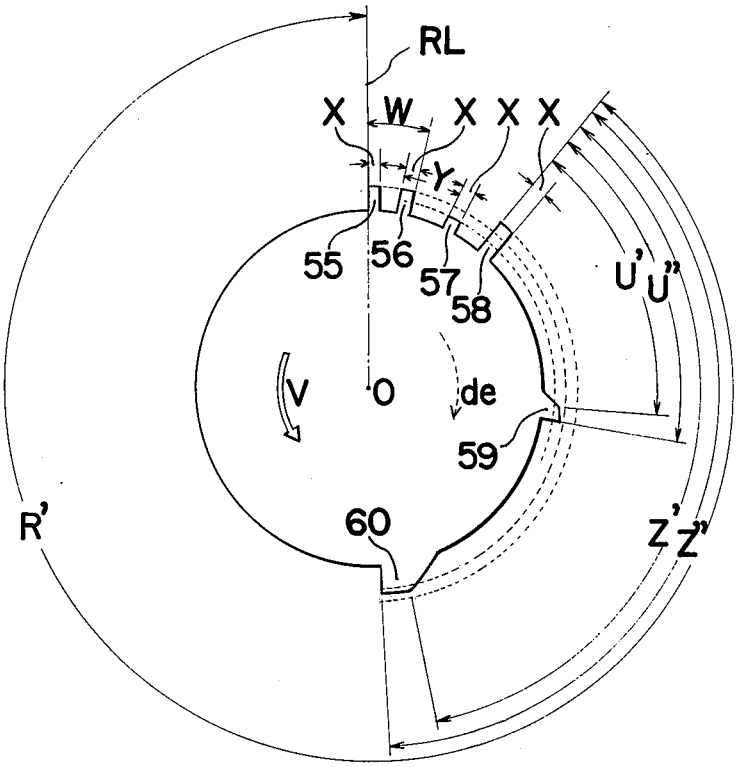
FIG. 7 is a similar view to FIG. 6, but particularly shows one cam plate for a detailed description thereof.
Figure 9:
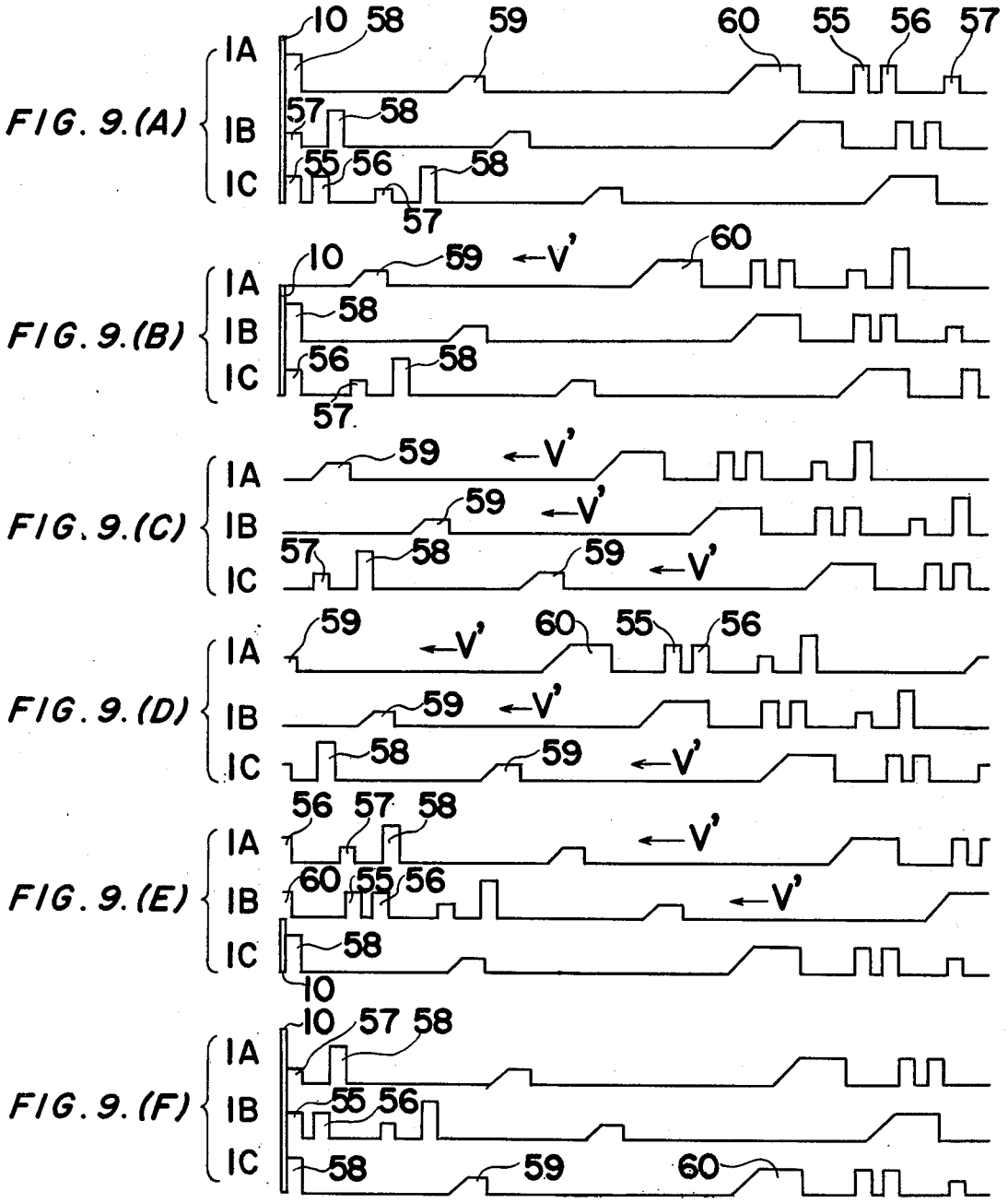

Referring particularly to FIG. 7, each of the cam plates 1A, 1B and 1C is provided with four detent projections 55, 56, 57 and 58, and also with two cam projections 59 and 60, which extend outwardly from the outer periphery of the cam plate a manner as described hereinbelow.

For the purpose of the present disclosure, these detent projections and cam projections are explained in connection with an imaginary reference line RL radially extending from the center O of the cam plate, and the angular degrees are measured in the clockwise direction *de*, while the cam plate rotating direction is the counter-clockwise direction V, thus causing the lock claw 10 to pass these projections in the order of projection 55, 56, 57, 58, 59 and 60.

The first detent projection 55 has a radial dimension X and the left side wall thereof coincides with the reference line RL. Adjacent the first detent projection 55 is the second detent projection 56, also having a radial dimension of X and the right side wall of the detent projection is spaced from the reference line RL by an angle or distance W in the direction *de*. The third detent projection 57 has a radial dimension of X and the left side wall thereof is spaced from the left side wall of the second detent projection 56 by an angle or distance Y in the direction *de*. The fourth detent projection 58 has a radial dimension of X and the left side wall thereof is spaced from the reference line RL by an angle or distance R', when measured from the detent projection 58 in the direction *de*. The first cam projection 59 has a slanted side edge or wall at least on the advancing side for allowing the lock claw 10 to slidingly pass the cam projection 59. In other words, the cam plate will not engage with the lock claw 10 thereat. This slanted edge of the cam projection 59 is spaced from the left side wall of the fourth detent projection 58 by an angle U', while the other side wall of the cam projection 59 is spaced from the left side wall of the fourth detent projection 58 by an angle U''. The second cam projection 60 also has a slanted side wall for the same reason as described with reference to the cam projection 59. This slanted side wall of the cam projection 60 is spaced from the left side wall of the detent projection 58 by an angle Z', while the other side wall of the cam projection 60 is spaced from the left side wall of the detent projection 58 by an angle Z''.

The heights of these above described projections are in a relation to each other as described hereinbelow.

The heights of the detent projections 55 and 56 are greater than that of the detent projection 57, but not as great as the height of the detent projection 58. On the other hand, the height of the cam projection 59 is less than those of the detent projections 55 and 56, but not as small as the height of the detent projection 57, while the height of the cam projection 60 is greater than those of the detent projections 55 and 56, but not as great as the detent projection 58.

Each of these three cam plates 1A, 1B and 1C are rotatably mounted on the driving shaft 3' and are sandwiched between rings (not shown) in the same manner as in the first embodiment.

It should be noted that the above described cam plates 1A, 1B and 1C are employed with known suitable switch units such as a magnet element for actuating a lead switch as described in the former embodiment or slits for actuating a photodiode or the like, upon receipt of the light through the slits, for producing signals which are used for controlling the various devices incorporated in the copying apparatus.

Before starting the operation of the copying apparatus, each of these three cam plates are adjusted into a starting position in which the detent projection on the first cam plate 1A is engaged with lock claw 10, the detent projection 57 on the second cam plate 1B is engaged with the lock claw and the detent projection 55 on the third cam plate 1C is engaged by the lock claw, as shown in FIG. 6 so that the time lag among these three cam plates 1A, 1B and 1C will result in the period *q*.

Although each of the cam plates will not be brought back to the above described starting position after one copying operation, the final position of one cam plate will match the starting position of the other cam plate. Therefore, once the cam plates 1A, 1B and 1C are adjusted into the above described positions, there is no need to readjust them again after every operation, since the movement of the cam plates are regulated in such a manner that the starting position will be reached again after every copying operation, which movement will be described in detail later in connection with FIGS. 9(A) to 9(F).

Referring to FIG. 8, a reference character T designates a period when the arc, containing the angle R′, passes the lock claw 10 during the rotation of each cam plates, while a reference character V designates a period when the arc, containing the angle (360-R′) passes the lock claw 10. The reference character Z designates a difference in time between the period T and the period *q*, while a reference character U designates a difference in time between the period T and the period 2*q*.

Before describing the movement of the cam plates 1A, 1B and 1C, it is to be noted that the positional relation between the detent projections are as follows.

Referring to FIG. 7, the angles U′ and U″ are larger than the angle U*a* (not shown), which is substantially equal to an angle through which the cams are rotated in the period U, but are not as large as the angle (U+V*a*), which angle V*a* is substantially equal to an angle through which the cams are rotated in the period V, while the angle (U″−U′) is larger than the angle X. On the other hand, each of the angles Z′ and Z″ is larger than the angle Z*a* which is substantially equal to an angle through which the cams are rotated in the period Z, but not as large as an angle (Z+V)*a* which is substantially equal to an angle through which the cams are rotated in the period (Z+V), while the anlge (ZΔ−Z′) is larger than the angle W, but not as large as the angle Y.

Referring particularly to FIGS. 9(A) to 9(F), there are shown diagrams of the detent projections of the three cam plates 1A, 1B and 1C developed on lines, instead of the circumferences of the cam plates, with an arrow V′ showing the direction of rotation of the cam plates 1A, 1B and 1C.

In the starting position, as shown in FIG. 9(A), the lock claw 10 is engaged with the cam plates 1A, 1B and 1C at the detent projections 58, 57 and 55, respectively.

Upon receipt of the first pulse P1, shown in FIG. 8, the lock claw 10 is shifted for a moment to disengage from all the three cam plates 1A, 1B and 1C. However, upon the return of the lock claw 10 to its first position, the cam plates 1B and 1C are again blocked from rotating by the engagement of sequential detent projections 58 and 56 respectively, while the cam plate 1A is rotated in the direction V′, as shown in FIG. 9(B). During the rotation of the cam plate 1A, the second pulse P2 is produced to shift the lock claw 10 for a moment for disengaging the lock claw from the detent projection 58 of the cam plate 1B and the detent projection 56 of the cam plate 1C, thus permitting rotation of all three cam plates 1A, 1B and 1C, as shown in FIG. 9(C). When the cam projection 59 of the cam plate 1A reaches the lock claw 10, the slanted side wall of the cam projection 59 mechanically shifts the lock claw 10 for allowing the detent projection 57 of the cam plate 1C to pass the lock claw 10, as shown in FIG. 9(D). Soon after the position shown in FIG. 9(D), the passing of the cam projection 59 permits the lock claw 10 to return to its original position thus blocking the cam plate 1C from rotating by the engagement of the claw 10 with the detent projection 58 formed on the cam plate 1C, as shown in FIG. 9(E). It should be noted that in the position shown in FIG. 9(E), the detent projection 58 will engage with the lock claw 10, even if the detent projection 58 reaches the lock claw 10 during the time when the lock claw 10 is lifted up by the cam projection 59 of the cam plate 1A, and the detent projection 58 positively engages with the lock claw 10, because the lock claw 10 is not raised high enough to permit the detent projection 58 to pass thereunder. In the mean time, when the detent projection 58 of the cam plate 1C is engaged, the cam plates 1A and 1B are rotated in the direction V′. Although the detent projections 55 and 56 of the cam plate 1A may arrive at the lock claw 10 while these cam plates are being rotated, the coincidental arrival of the cam projection 60 of the cam plate 1C will mechanically shift and raise the lock claw 10 for allowing the detent projections 55 and 56 to pass thereunder without any engagement with the lock claw 10. Therefore, the cam plate 1A is rotated until the engagement of the next detent projection 57 and the cam plate 1B is rotated until the engagement of the next detent projection 55, and thus the cam plates 1A, 1B and 1C are in the starting position, as shown in FIG. 9(F), with the final positions of the cam plates 1A, 1B and 1C corresponding with the starting positions of the cam plates 1B, 1C and 1A, respectively.

Although in the above described movement of the cam plates 1A, 1B and 1C, the lock claw 10 is forcibly shifted twice by the pulses P1 and P2 in one operation, it is possible to effect the operation with only one pulse or with three pulses in a manner described hereinbelow.

First, when only one pulse P1 is provided in one operation, the pulse P1 will shift the lock claw 10 for a predetermined period of time to disengage it from the detent projection 58, 57, and 55 of the cam plates 1A, 1B and 1C, respectively, as shown in FIG. 9(A). Subsequently, the detent projections 58 and 56 of the cam plates 1B and 1C will engage with the lock claw 10, while the cam plate 1A will continually rotate, as shown in FIG. 9(B). However, in the next step, the shifting of the lock claw 10 is not effected by the second pulse, but by the successively arriving cam projections 59 and 60 of the cam plate 1A, which will mechanically shift the lock claw 10 for allowing the detent projection 58 of the cam plate 1B and the detent projections 56 and 57 of the cam plates 1C to pass the lock claw 10. By the time when the detent projection 55 of the cam plate 1A engages with the lock claw 10, the cam plate 1B is held in the position by the engagement of the detent projection 58 thereof with the lock claw 10, and the cam plate 1C is held in the position by the engagement of the detent projection 57 with the lock claw 10, thus resetting the cam plates in the starting positions.

Secondly, when three pulses are provided for shifting the lock claw 10 in one copying operation, the first two pulses will operate the cam plates in the same manner as described for the two pulses, causing the cam plates 1A, 1B and 1C to be reset in the starting positions, and the third pulse will operate the cam plates in the same manner as described above for one pulse, causing the cam plates 1A, 1B and 1C to be reset again in the starting position.

Referring now to FIG. 10, there is shown another embodiment of the sequential controller S'' of the present invention, which comprises a sprocket 100 integrally with formed or fixedly mounted on a shaft 102 which is rotated in a direction AX by a suitable driving means (not shown), a first cam unit 104 rotatably mounted on the shaft 102 and a second cam unit 106 also rotatably mounted on the shaft 102. The first cam unit 104 comprises a first clutch cam 108 having a bore **108*a* in the center portion thereof for receiving a clutch spring 110 with one end portion 110*a* of the clutch spring 110 being engaged with a groove 108*b* formed on the first clutch cam 108, while the one end face of the clutch cam 108 is fixedly coupled with a first cam plate 112 by suitable securing screws (not shown). Although this first cam unit 104 is normally rotated simultaneously with the shaft 102 by the grip of the clutch spring 110 on the shaft 102, a suitable external force on the first cam unit 104 will restrict the first cam unit 104 to prevent rotation about the shaft 102 against the frictional force between the shaft 102 and the clutch spring 110. The second cam unit 106 also comprises a second clutch cam 114, a clutch spring 116 inserted into the second clutch cam 114 and a second cam plate 118 fixedly secured on the end face of the second clutch cam 114, which are constructed in the same manner as in the first cam unit 104**.

The sequential controller S'' further comprises lock claws 120 and 122, each of which has a claw at one end portion, while the other end portion is connected to a plunger 124 of a solenoid 126, and is pivotally supported by a coaxial shaft 128, normally being urged to rotate clockwise by a suitable urging means (not shown). Each of these lock claws 120 and 122 are positioned in such a manner that the tip ends of the claws normally contact the peripheral surface of the clutch cams 108 and 114, respectively, but the tip end of the claw is separated from the peripheral surface of the clutch cam by the retraction of the plunger 124 into the solenoid 126 upon feeding a signal to the solenoid 126.

Referring to FIGS. 11(A) and 11(B), each of the first and second clutch cams 108 and 114 have a plurality of detent recesses on the outer peripheral surface thereof for restricting the rotation thereof by the engagement of the claw into any one of the detent recesses. As most clearly seen in FIG. 11(A), the first clutch cam 108 has two detent recesses **108*m* and 108*n* formed on diametrically opposite sides of the cam from each other, while the second clutch cam 114 has two detent recesses 114*m* and 114*n*** formed adjacent to each other, as shown in FIG. 11(B).

Positioned adjacent to the cam plate 112 is a microswitch 130 with an arm **130*a* slidably contacting the outer peripheral surface of the cam plate 112, and the outer peripheral surface of the cam plate 112 has recesses 112*a* and 112*b* for receiving the arm 130*a* therein during the rotation of the cam plate 112, thus causing the microswitch 130** to be in one and off states alternately.

The cam plate 118 is provided with three switching elements **118*a*, 118*b* and 118*c*, and three cooperative microswitches 132, 134 and 136 are provided in positions such that the arms 132*a*, 134*a* and 136*a* of the microswitches project into the paths of the three switching elements 118*a*, 118*b* and 118*c*, respectively, thus switching on and off the microswitches 132, 134 and 136**.

Before starting the operation of the sequential controller S'', the clutch cams 108 and 114 are brought into such positions that the lock claw is engaged in the detent recess **108*m* and the lock claw 122 is engaged in the detent recess 114*m*** as shown in FIGS. 11(A) and 11(B).

Upon feeding of the sheet of copy paper (not shown) into the copying apparatus (not shown) a copy paper sensing element (not shown) produces a signal which is supplied to the solenoid 126 to energize it for disengaging the lock claws 120 and 122 from the clutch cams 108 and 114. Soon after said disengagement, the lock claws 120 and 122 are returned into their normal positions by the suitable urging means.

The first clutch cam 108 is rotated together with the cam plate 112, until the lock claw 120 engages with the detent recess **108*n*, while the second clutch cam 114 is rotated together with the cam plate 118 until the lock claw 122 engages with the detent recess 114*n***.

After the sheet of copy paper has been fed through the copying apparatus, another copy paper sensing element (not shown) incorporated in the copying apparatus near the copy paper discharge opening produces a signal for de-energizing the solenoid 126 for disengaging the lock claws 120 and 122 from the detent recesses **108*n* and 114*n*, whereby the clutch means 108 and 114 again rotate together with the shaft 102**.

The clutch cam 108 is now rotated until the lock claw 120 engages with the detent recess **108*m*, and the clutch cam 114 is rotated until the lock claw 122 engages with the detent recess 114*m***, whereby the clutch cams are brought into their starting position for finishing one copying operation.

In the mean time, as the clutch cams 112 and 118 are being rotated, the coincidently rotated cam plates 112 and 118 control the on and off operation of the microswitches 130, 132, 134 and 136 for controlling the operating period of the various component devices incorporated in the copying apparatus.

It should be noted that the timing for controlling the various devices can be easily regulated by forming the detent recesses **112*a* and 112*b* in other positions and/or by shifting the position of the switching elements 118*a*, 118*b* and 118*c***.

It should also be noted that the microswitches described as employed in the sequential controller S'' can be replaced by any suitable known switch units, such as a lead switch with a magnetic element described as employed in the sequential controller S of the first embodiment.

It should be noted that in the sequential controller S'', the transmission of the driving force of the shaft 102 to the cam plates is effected through the clutch spring, while in the sequential controllers S and S', the transmission of the driving force of the shaft 2 to the cam plates is through the friction members, and that these transmission means can be alternatively utilized.

Although in the sequential controller S'', the cam plates are coupled with auxiliary clutch cams having detent recesses for regulating the rotation thereof, while in the sequential controller S and S', the cam plates themselves have the detent recesses or the like, for regulating the rotation thereof, these regulating means can be alternatively utilized.

As fully described hereinabove, according to the sequential controller of the present invention, the cam plates for controlling the operating periods of the various devices can be provided with more switching units such as detent recesses, detent projections or magnet elements etc. for controlling number of devices incorporated, for example, in the copying apparatus, and also, the number of cam plates can be increased for controlling more intricate timings for operating various component devices.

It should further be noted that the cam plates described as employed in the sequential controller of the present invention, can be replaced, for example, by endless belts provided with projections in predetermined positions on the surface thereof, and which endless belts can be connected between driving rolls for moving the belts to actuate the switch units disposed therearound in a similar manner as with the cam plates.

Although the sequential controller of the invention has been described in connection with a copying apparatus, it should be noted that the sequential controller of the present invention can be employed in any type of apparatuses, as long as the devices incorporated in the apparatus are required to be regulated for their operating periods.

Although the present invention has been fully described by way of example with reference to the attached drawings, it is to be noted that various changes and modifications are apparent to those skilled in the art. Therefore, unless otherwise, such changes and modifications depart from the scope of the present invention, they should be construed as included therein.

What is claimed is:

1. A sequential controller for use in an apparatus provided with a plurality of devices for controlling the operating periods of each of the devices, comprising:

a. at least first and second rotary members rotatably supported on a common axis and each having detent means thereon with said first rotary member having at least two detent means and the detent means on said second rotary member is different from the detent means on said first rotary member;

a. ' at least first and second switch means responsive to rotation of the corresponding one of said rotary members for controlling operating periods of a corresponding device;

b. a driving means for driving the rotary members, and friction means provided between the driving means and the rotary members through which the driving force is transmitted to the rotary members;

c. lock means urged against said rotary members and engageable with said detent means for preventing the rotary members from rotating and disengageable from said detent means for freeing said rotary members to be rotated by said driving means; and d. a single disengaging means associated with said lock means for disengaging said lock means from said detent means for a time sufficient to free all of said rotary members for rotation and then for causing said lock means to re-engage with said rotary members for engaging the detent means on one rotary member at a time different from the time of engagement of the lock means with the detent means on the other rotary member, whereby the rotation of one rotary member is terminated earlier by the engagement of said lock means with the detent means thereon and the rotation of the other rotary member is terminated thereafter and the operating periods of the devices are controlled in accordance with respective rotations of said rotary members and said switch means responsive thereto.

2. A sequential controller as claimed in claim 1 wherein said second rotary member has at least two detent means with one of said detent means angularly displaced in the direction of rotation from said one detent means on said first rotary member.

3. A sequential controller as claimed in claim 1 wherein said second rotary member has a single detent means for engagement by said lock means together with one of said detent means of said first rotary member.

4. A sequential controller as claimed in claim 1 wherein said lock member is a pivotally rotating lever member having a claw member at one end thereof, the other end portion thereof being connected with said disengaging means for pivoting said lever member.

5. A sequential controller for use in an apparatus provided with a plurality of devices for controlling the operating periods of each of the devices, comprising:

a. at least first and second cam members rotatably supported on a common axis and each having detent means thereon at circumferential portions thereof, said first cam member having at least first and second detent means and the detent means on said second cam member being different from the detent means on said first cam member;

a'. at least first and second switch means responsive to rotation of a corresponding one of said cam members for controlling operating periods of a corresonding device;

b. a driving means for driving the cam members, and friction means provided between the driving means and the cam members through which the driving force is transmitted to said cam members;

c. lock means urged against the circumferences of said cam members and engageable with said detent means for preventing the cam members from rotating and disengageable from said detent means for freeing said cam members to be rotated by said driving means; and d. a single disengaging means associated with said lock means for disengaging said lock means from said detent means for a time sufficient to free all of said cam members for rotation and then for causing said lock means to re-engage said cam members for engaging the detent means on one cam member at a time different from the time of engagement of the locking means with the detent means on the other cam member, whereby the rotation of one cam member is terminated earlier by the engagement of said lock means with the detent means thereon and the rotation of the other cam member is terminated thereafter and the operating periods of the devices are controlled in accordance with respective rotations of said cam members and said switch means responsive thereto.

6. A sequential controller as claimed in claim 5 wherein said second cam member has at least two detent means with one of said detent means angularly displaced in the direction of rotation from said one detent means on said first cam member.

7. A sequential controller as claimed in claim 5 wherein said second cam member has a single detent means for engagement by said lock means together with one of said detent means of said first cam member.

8. A sequential controller as claimed in claim 5 wherein said lock member is a pivotally rotating level member having a claw member at one end thereof, the other end portion thereof being connected with said disengaging means for pivoting said lever member.

9. A sequential controller for use in an apparatus provided with a plurality of devices for controlling the operating periods of each of the devices, comprising:

a. at least two disk-shaped rotary members rotatably supported on a common axis, said first rotary member having a diameter smaller than that of said second rotary member, and having a first projection having the radially outer end substantially even with the outer periphery of said second rotary member and a second projection at a position subsequent to said first projection in the direction of rotation of said rotary member and having the radially outer end extending beyond that of said first projection, said second rotary member being provided with a recess having the inner end thereof approximately even with the outer periphery of said first rotary member;

a'. at least first and second switch means responsive to rotation of the corresponding one of said rotary members for controlling operating periods of a corresponding device;

b. a driving means for driving the rotary members, and friction means provided between the driving means and the rotary members through which the driving force is transmitted to the rotary members;

c. a pivotally supported lock lever member having a claw portion at the distal end thereof having a width in the direction of said common axis greater than the distance between the rotary members and engageable with said projections and recess and urged in a direction for contacting the circumferential portions of said rotary members for stopping rotation of said rotary members by said driving means upon engagement of said claw portion with said projections and recesses of said rotary members and permitting said rotary members to be rotated by said driving means upon disengagement of said claw portion from said projections and recesses;

d. a disengaging means coupled with said lock lever member for spacing said claw portion of said lock lever member from said rotary members against said urging force a distance sufficient to allow said first projection to pass said claw portion and to free said claw portion from said recess and for a time sufficient to free all said rotary members for rotation and then for causing said claw portion to be urged toward said rotary members, whereby said first rotary member is stopped again by engagement of said second projection with said claw portion of said lock lever member, and said claw portion simultaneously engaging the periphery of said second rotary member and, said second rotary member continuing to rotate.

10. A sequential controller for use in an apparatus provided with a plurality of devices for controlling the operating periods of each of the devices, comprising:

a. at least two cylindrical rotary members rotatably supported on a common axis, said rotary members each having at least two notches therein with the angle between the first notch and the second notch in said first rotary member being less than that between the first notch and second notch in said second rotary member;

a. ' at least first and second switch means responsive to rotation of the corresponding one of said rotary members for controlling operating periods of a corresponding device;

b. a driving means for driving the rotary members, and friction means provided between the driving means and the rotary members through which the driving force is transmitted to the rotary members;

c. pivotally supported lock lever members, one for each of said rotary members and each having a claw portion engageable with said notches, said claw portion being urged in a direction to contact the circumferential portion of said rotary members, each of said lock lever members independently engaging in the notches of the corresponding rotary member for stopping rotation of said rotary member, and said rotary members being rotated by said driving means upon release of the engagement of said claw portions; and d. a disengaging means commonly coupled to corresponding ends of said lock lever members for simultaneously spacing said claw portions of all of said lock lever members from the circumferential portions of said rotary members against the urging force a distance sufficient to free the claw portions from said recesses and for a time sufficient to free all said rotary members for rotation and then for causing said claw portions to be urged toward said rotary members, whereby said first rotary member and second rotary member simultaneously start rotation upon simultaneous disengagement of said lock lever members from said notches and said first rotary member is stopped earlier than said second rotary member due to engagement of said second notch in said first rotary member and the corresponding lock lever member earlier than the corresponding action of said second rotary member.

11. A sequential controller as claimed in claim 10 wherein at least one of said rotary members has a rotary switching means rotating together with the rotary member for switching the corresponding switch member.

12. A sequential controller for use in an apparatus provided with a plurality of devices for controlling the operating periods of each of the devices, comprising:

a. at least first and second rotary members rotatably supported on a common axis and each having detent means thereon with said first rotary member having at least two detent means and the detent means on said second rotary member being at a different angle of rotation relative to said common axis from the detent means on said first rotary member;

a. ' at least first and second switch means responsive to rotation of the corresponding one of said rotary members for controlling operating periods of a corresponding device;

b. a driving means for driving the rotary members, and friction means provided between the driving means and the rotary members through which the driving force is transmitted to the rotary members;

c. lock means urged against said rotary members and engageable with said detent means for preventing the rotary members from rotating and disengageable from said detent means for freeing said rotary members to be rotated by said driving means; and d. a single disengaging means associated with said lock means for disengaging said lock means from said detent means for a time sufficient to free all of said rotary members for rotation and then for causing said lock means to re-engage with said rotary members for engaging the detent means on one rotary member at a time different from the time of engagement of the lock means with the detent means on the other rotary member, whereby the rotation of one rotary member is terminated earlier by the engagement of said lock means with the detent means thereon and the rotation of the other rotary member is terminated thereafter and the operating periods of the devices are controlled in accordance with respective rotations of said rotary members and said switch means responsive thereto.

13. A sequential controller as claimed in claim 12, wherein at least one of said rotary members has a cam surface for releasing locking between said lock means and detent means provided on the other of said rotary members.

* * * * *